US008646429B2

(12) United States Patent
Agneray et al.

(10) Patent No.: US 8,646,429 B2
(45) Date of Patent: Feb. 11, 2014

(54) CONTROL OF A PLURALITY OF PLUG COILS VIA A SINGLE POWER STAGE

(75) Inventors: Andre Agneray, Boulogne (FR); Clement Nouvel, Verneuil sur Seine (FR); Xavier Jaffrezic, Velizy (FR)

(73) Assignee: Renault S.A.S., Boulogne Billancourt (FR)

( * ) Notice: Subject to any disclaimer, the term of this patent is extended or adjusted under 35 U.S.C. 154(b) by 896 days.

(21) Appl. No.: 12/528,452

(22) PCT Filed: Feb. 25, 2008

(86) PCT No.: PCT/FR2008/050311

§ 371 (c)(1),
(2), (4) Date: Nov. 17, 2009

(87) PCT Pub. No.: WO2008/113956

PCT Pub. Date: Sep. 25, 2008

(65) Prior Publication Data

US 2010/0313841 A1 Dec. 16, 2010

(30) Foreign Application Priority Data

Mar. 1, 2007 (FR) ..... 07 01500

(51) Int. Cl.
*H01T 13/08* (2006.01)

(52) U.S. Cl.
USPC ..... 123/196 R; 123/145 A; 123/605

(58) Field of Classification Search
USPC ..... 123/169 R, 143 A, 143 B, 406.19, 604, 123/605, 608, 620–623, 629, 143 R, 145 A, 123/145 R, 634, 640; 219/721; 701/102–105
See application file for complete search history.

(56) References Cited

U.S. PATENT DOCUMENTS

| | | | | | |
|---|---|---|---|---|---|
| 4,327,702 | A | * | 5/1982 | Imai et al. | 123/620 |
| 4,369,756 | A | * | 1/1983 | Ezoe | 123/620 |
| 4,369,758 | A | * | 1/1983 | Endo | 123/620 |
| 4,396,855 | A | * | 8/1983 | Imai et al. | 313/139 |
| 4,418,660 | A | * | 12/1983 | Endo et al. | 123/143 B |
| 4,510,915 | A | * | 4/1985 | Ishikawa et al. | 123/620 |
| 4,562,823 | A | * | 1/1986 | Moritugu et al. | 123/620 |

(Continued)

FOREIGN PATENT DOCUMENTS

| | | |
|---|---|---|
| DE | 10 2005 036 968 | 2/2007 |
| FR | 2 859 869 | 3/2005 |

OTHER PUBLICATIONS

U.S. Appl. No. 13/057,349, filed Feb. 3, 2011, Agneray, et al.

*Primary Examiner* — John Kwon
*Assistant Examiner* — Johnny Hoang
(74) *Attorney, Agent, or Firm* — Oblon, Spivak, McClelland, Maier & Neustadt, L.L.P.

(57) ABSTRACT

A plasma generating device including: a supply circuit including a switch controlled by a control signal for applying an intermediate voltage on an output of the control circuit at a frequency defined by the control signal; a plurality of plasma-generating plug coils arranged in parallel on the output via connectors, each connector being adapted to be removably connected to a corresponding plug coil and including a mechanism adapted to offset the resonance frequency of the plug coil so that each plug coil has a distinct resonance frequency; a control device of the supply circuit, that determines the control frequency from the resonance frequencies of the plug coils to selectively control the plug coils according to the control frequency used.

12 Claims, 4 Drawing Sheets

(56) References Cited

U.S. PATENT DOCUMENTS

| | | | | |
|---|---|---|---|---|
| 5,315,982 | A * | 5/1994 | Ward et al. | 123/634 |
| 5,587,630 | A | 12/1996 | Dooley | |
| 6,142,130 | A * | 11/2000 | Ward | 123/606 |
| 6,483,079 | B2 * | 11/2002 | Sato et al. | 219/270 |
| 6,550,463 | B1 * | 4/2003 | Schmolla | 123/606 |
| 6,553,981 | B1 * | 4/2003 | Suckewer et al. | 123/620 |
| 6,662,793 | B1 * | 12/2003 | Allen et al. | 123/620 |
| 7,714,488 | B2 * | 5/2010 | Nagasawa et al. | 313/130 |
| 8,096,276 | B2 * | 1/2012 | Aida et al. | 123/143 B |
| 2008/0121200 | A1 * | 5/2008 | Kato et al. | 123/143 B |
| 2008/0149083 | A1 * | 6/2008 | Katoh et al. | 123/634 |
| 2009/0007893 | A1 * | 1/2009 | Kato et al. | 123/596 |
| 2009/0188458 | A1 * | 7/2009 | Visser et al. | 123/169 R |

* cited by examiner

CONTROL OF A PLURALITY OF PLUG COILS VIA A SINGLE POWER STAGE

TITLE OF THE INVENTION

BACKGROUND OF THE INVENTION

The present invention generally relates to systems for generating plasma between two electrodes of a spark plug, these systems being particularly used for the controlled radio-frequency ignition of a gas mixture in combustion chambers of an internal combustion engine.

For such an application to automobile ignition with plasma generation, plasma-generating circuits incorporating coil-spark plug assemblies are used to generate multifilament discharges between their electrodes, making it possible to initiate combustion of the mixture in the combustion chambers of the engine. The multi-spark plug is described in detail in the following patent applications filed in the name of the applicant: FR 03-10766, FR 03-10767 and FR 03-10768.

Such a coil-spark plug assembly is conventionally modeled by a resonator 1 whose resonant frequency $F_c$ is greater than 1 MHz, typically close to 5 MHz. The resonator comprises in series a resistor R, an inductor L and a capacitor C. Ignition electrodes 10 and 12 of the coil-spark plug assembly are connected to the terminals of the capacitor C.

When the resonator is supplied with a high voltage at its resonant frequency $f_c$ $(1/(2\pi\sqrt{L*C}))$, the amplitude at the terminals of the capacitor C is amplified, making it possible to develop multifilament discharges between the electrodes of the spark plug over distances of the order of a centimeter, with a high pressure and for peak voltages of less than 20 kV.

The sparks are then referred to as branched sparks in so far as they entail the simultaneous generation of at least a number of ionization lines or paths within a given volume, their branches additionally being omnidirectional.

Controlling the power supply of such a coil-spark plug assembly requires the use of a supply circuit that is capable of generating voltage pulses, typically of the order of 100 ns, which may reach amplitudes of the order of 1 kV, at a frequency intended to be very close to the resonant frequency of the radio-frequency resonator of the coil-spark plug assembly. The smaller the difference between the resonant frequency of the resonator and the operating frequency of the generator, the higher the overvoltage coefficient of the resonator (ratio between the amplitude of its output voltage and its input voltage).

Such a supply circuit, described moreover in detail in patent application FR 03-10767, is schematically represented in FIG. 2. It conventionally employs a "Class-E power amplifier" setup. This type of DC/AC converter makes it possible to create the voltage pulses with the aforementioned characteristics.

According to the embodiment in FIG. 2, the amplifier 2 comprises a MOSFET power transistor M used as a switch for controlling the switchings at the terminals of the resonator 1.

Thus, a control device 5 generates and applies a control signal V1 at a control frequency to the gate of the power MOSFET M, via a control stage 3 which is represented schematically. In order to control the production of sparks between the electrodes of the coil-spark plug assembly connected at the output of the amplifier when its resonator 1 is excited by means of the control signal V1, said signal is not permanent but is present in the form of control pulse trains at the control frequency.

As described in patent application EP-A-1 515 594, a parallel resonant circuit 4 is connected between a source of intermediate voltage Vinter and the drain of the transistor M. This circuit 4 comprises an inductor Lp in parallel with a capacitor Cp.

Close to its resonant frequency, the parallel resonator converts the intermediate voltage Vinter into an amplified voltage Va (illustrated in FIG. 5), corresponding to the intermediate voltage multiplied by the overvoltage coefficient of the parallel resonator. This amplified voltage is provided on the drain of the transistor M connected moreover to the input of the resonator 1.

The transistor M therefore acts as a switch and applies (or blocks) the voltage Va at the input of the resonator 1 when the control signal V1 is in the high (or low) logic state. The transistor M thus imposes a switching frequency, determined by the control signal V1, which is sought to be made as close as possible to the resonant frequency of the coil-spark plug assembly connected at the output (typically 5 MHz), in order to maintain and to maximize the transfer of energy between the parallel resonator 4 and the series resonator 1 forming the coil-spark plug assembly.

At the resonant frequency of the coil-spark plug assembly, the output voltage Va mentioned above, multiplied by the overvoltage coefficient of the series resonator 1, then appears at the terminals of the capacitor C of the series resonator 1, that is to say at the terminals of the electrodes at the spark plug.

This phase of energy transfer from the power stage formed by the amplifier to the resonator of the coil-spark plug assembly must be carried out at the resonator frequency of the resonator in order to ensure good efficiency. Specifically, if the transistor M imposes a switching frequency which differs from the resonant frequency of the coil-spark plug assembly, the energy transfer is degraded owing to the narrowness of the passband of the series resonator used for the coil-spark plug assembly.

In an application to automobile ignition with plasma generation, each combustion chamber is equipped with a coil-spark plug assembly as described above in order to initiate combustion on command.

Consequently, in the case of 4-cylinder engines, for example, four supply circuits of the class-E amplifier type, as described above with reference to FIG. 2, must be able to be made available in order to supply and control the four coil-spark plug assemblies respectively.

Such a configuration thus based on having as many amplification paths as there are coil-spark plug assemblies to be controlled then limits the development potential of this type of automobile ignition by plasma generation, not only because of the space requirement entailed by this installation below the engine hood, but also because of the installation cost, which may prove to be prohibitive for envisioning the installation of this type of ignition in mass-produced vehicles.

SUMMARY OF THE INVENTION

The present invention aims to overcome this disadvantage by making it possible to control a plurality of coil-spark plug assemblies by means of one and the same amplification path.

With this objective in view, the invention relates to a plasma-generating device, characterized in that it comprises:

- a supply circuit comprising a switch controlled by a control signal in order to apply an intermediate voltage to an output of the supply circuit at a frequency defined by the control signal, a plurality of plasma-generating coil-spark plug assemblies arranged in parallel on the output of the supply circuit via connectors, each connector being designed to be connected in a removable manner to a corresponding coil-spark plug assembly and comprising means designed to offset the resonant frequency of said coil-spark plug assembly such that each coil-spark plug assembly has a separate resonant frequency, a control device for the supply circuit that determines the frequency of the control signal from one of the resonant frequencies of the coil-spark plug assemblies so as to selectively control the coil-spark plug assemblies according to the control frequency used.

Advantageously, each plasma-generating coil-spark plug assembly comprises a resonator having a frequency above 1 MHz and comprising two electrodes, the resonator being capable of generating a plasma between the two electrodes when a high-voltage level is applied to the output of the supply circuit.

According to one embodiment, the connectors are assembled among themselves using a common connection element.

Preferably, the connection element comprises foolproof means whereby it can be fastened to the plurality of coil-spark plug assemblies in a single manner.

Advantageously, the means designed to offset the resonant frequency of a coil-spark plug assembly comprise means for modifying the inductance value of the coil-spark plug assembly that are situated in the immediate vicinity of said assembly.

According to one embodiment, the means for modifying the inductance value of the coil-spark plug assembly comprise a winding positioned directly in contact with a winding of the coil-spark plug assembly.

Preferably, the winding of the modifying means is arranged around an element made of magnetic material.

Preferably, the winding of the modifying means is at least partly surrounded by an element made of magnetic material.

According to another embodiment, the means for modifying the inductance value of the coil-spark plug assembly comprise an element made of magnetic material positioned directly against a winding of the coil-spark plug assembly.

Preferably, the element made of magnetic material surrounds at least part of the end of the winding of the coil-spark plug assembly.

Preferably, the element made of magnetic material comprises a central core inserted into the winding of the coil-spark plug assembly.

According to one embodiment, the magnetic material comprises ferrite.

BRIEF DESCRIPTION OF THE DRAWINGS

Other features and advantages of the present invention will become more clearly apparent on reading the following description given by way of non-limiting illustrative example with reference to the appended figures, in which.

DETAILED DESCRIPTION OF THE INVENTION

Figure 1:
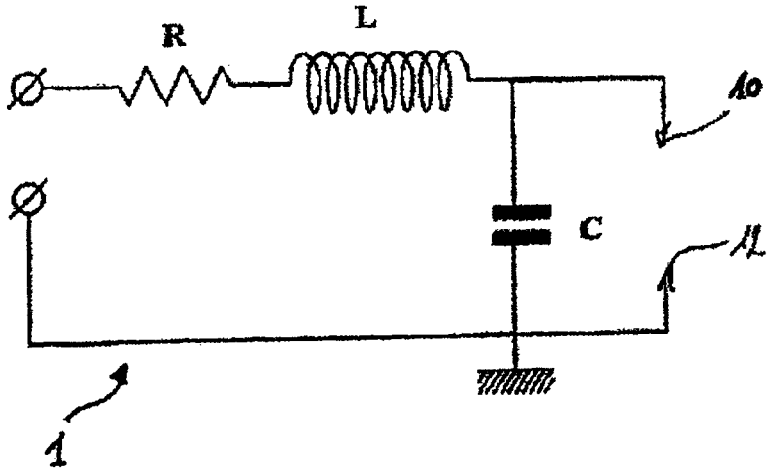
FIG. 1 is a diagram illustrating an electric model used for the resonator modeling a plasma-generating coil-spark plug assembly.
Figure 2:
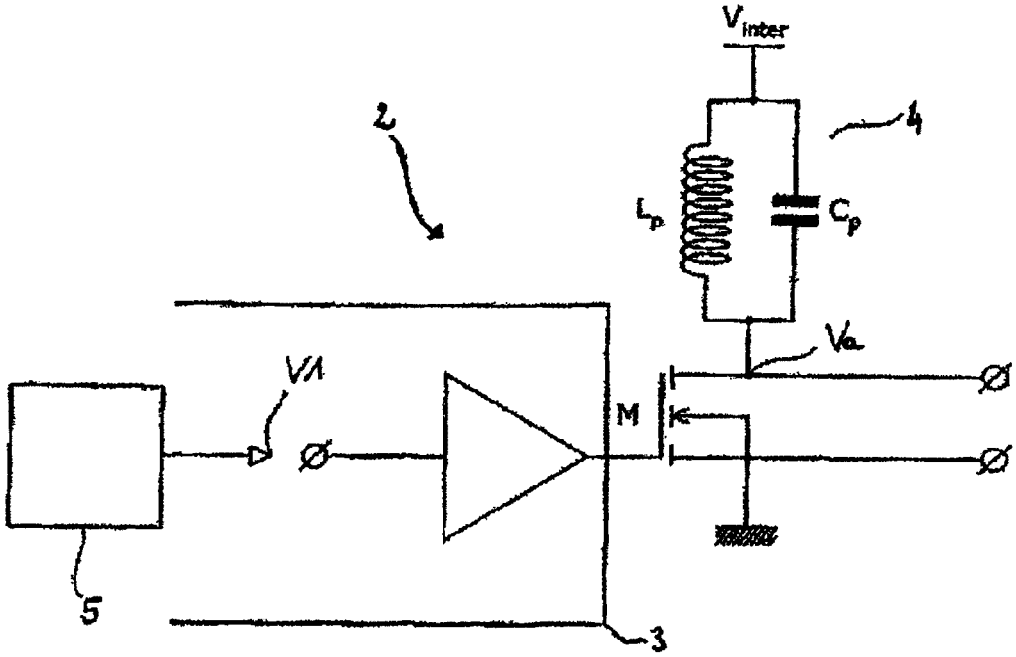
FIG. 2 is a diagram illustrating a device for generating a high voltage incorporating an amplifier, used for the supply and control of a coil-spark plug assembly.

The present invention proposes to control a plurality of coil-spark plug assemblies by using a single amplification path, in other words by using a single supply circuit of the class-E power amplifier type described above in FIG. 2, in order to selectively supply the plurality of coil-spark plug assemblies connected in parallel at the output of this single supply circuit.

Figure 3:
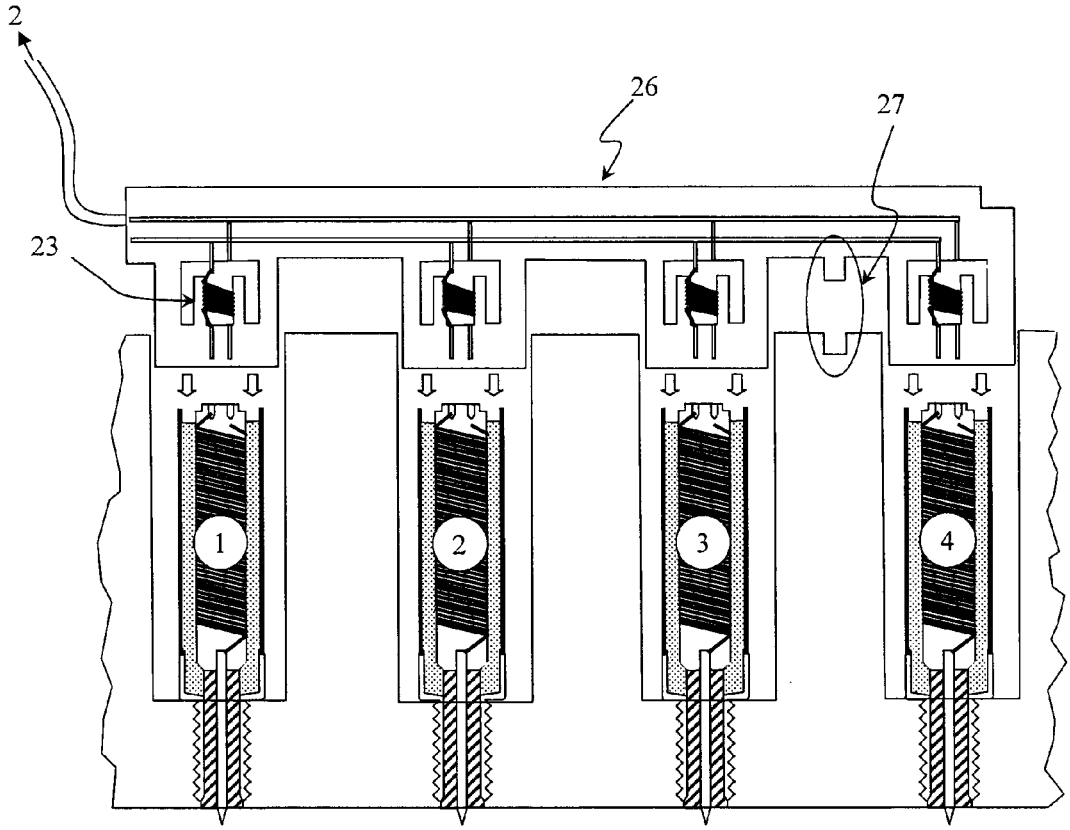
FIG. 3 illustrates a complete diagram of a radio-frequency ignition system according to the invention, comprising 4 spark plug-coil assemblies arranged in parallel at the output of a single supply stage.

FIG. 3 illustrates such an architecture, in which the single supply circuit 2 is used, according to the invention, to separately control 4 (and by extension N) coil-spark plug assemblies, namely BB1, BB2, BB3 and BB4, respectively, connected in parallel to the output of the supply circuit via connection means.

Conventionally, the connection means consist of a plurality of connectors 20, each being designed to be connected in a removable manner to a corresponding coil-spark plug assembly of the plurality of coil-spark plug assemblies.

The condition for making it possible to independently control the plurality of coil-spark plug assemblies by means of the single supply circuit is that each of the plasma-generating coil-spark plug assemblies has its own resonant frequency quite separate from the others. The specific aim here is to avoid superimpositions of the resonance frequency domains of the resonators each forming a coil-spark plug assembly and thus to overcome problems of simultaneous multiple ignitions.

However, since each coil-spark plug assembly preferably has an identical resonant frequency for reasons relating to the efficiency of the industrial production process for these spark plugs in particular, the present invention makes provision to include in each connector 20 means designed to offset, in a predetermined manner, the resonant frequency of the corresponding coil-spark plug assembly such that each coil-spark plug assembly has a separate resonant frequency.

The frequency distribution of the coil-spark plug assemblies thus achieved must be such that the resonant frequency difference between the coil-spark plug assemblies is, preferably, greater than the passband of each resonator. A difference greater than twice the passband of the resonator will be chosen, for example.

Such a resonant frequency distribution of the coil-spark plug assemblies thus enables the single power stage to be mutualized, and makes it possible to separately control the 4 coil-spark plug assemblies from the single supply circuit 2, thus offering large cost and volume savings for the ignition system.

Figure 4A:
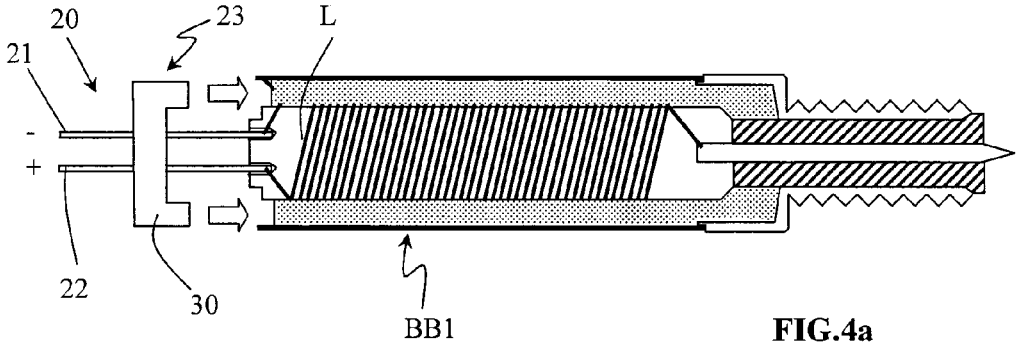
FIGS. 4*a* to 4*c* illustrate various embodiments of means for offsetting the resonant frequency of each coil-spark plug assembly, which are intended to be incorporated in the connection means for the coil-spark plug assemblies.

FIG. 4*a* illustrates the connector 20 of the coil-spark plug assembly BB1. It is situated in the immediate vicinity of said assembly and is formed by two conductors 21 and 22, which are required for the control.

Each connector 20 thus incorporates means 23 which are designed to offset the resonant frequency of the corresponding coil-spark plug assembly in a predetermined manner such that the offset resonant frequencies of all the coil-spark plug assemblies thus satisfy the above-defined principles, namely that the resonant frequencies of each coil-spark plug assembly are offset with respect to one another by a value preferably greater than twice the passband of each coil-spark plug assembly.

More precisely, the means 23 designed to offset the resonant frequency of the corresponding coil-spark plug assembly comprise means for modifying the inductance value of the coil-spark plug assembly that are intended to be situated in the immediate vicinity of said assembly.

According to a first embodiment described in FIG. 4*a*, these means for modifying the inductance value of the coil-spark plug assembly comprise an element 30 made of magnetic material that is intended to be positioned directly against a winding L of the coil-spark plug assembly.

The inductance of the coil-spark plug assembly has its value modified as a function of the magnetic material coupled directly to its winding and, more particularly, as a function of the nature of the material and of the geometry of the element placed adjacent to the winding.

By way of example, use may be made of a ferrite-type magnetic material.

Figure 4B:
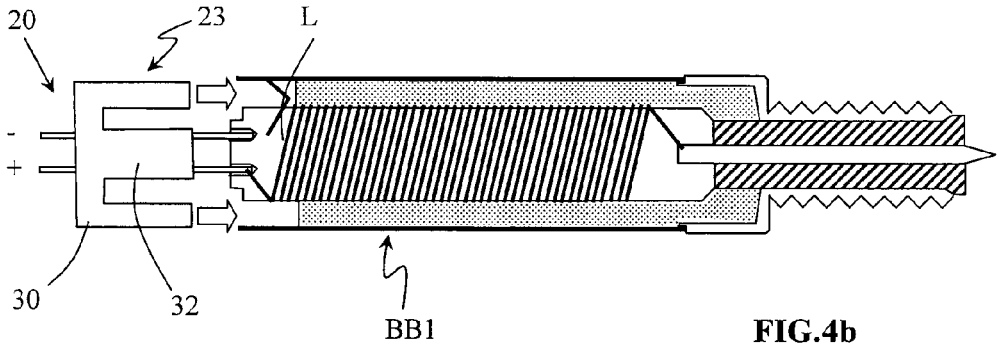

According to a second embodiment represented in FIG. 4*b*, the element 30 made of magnetic material comprises a central core 32 intended to be inserted into the winding L of the coil-spark plug assembly.

According to one variant, the element 30 made of magnetic material is configured so as to surround at least part of the end of the winding L of the coil-spark plug assembly. This configuration also has the advantage of improving the overvoltage coefficient of the coil-spark plug assembly.

It is found, however, that distributing the resonant frequencies of the coil-spark plug assemblies as desired requires the use in certain cases of a ferrite whose length extends up to a third of the winding, a situation which may pose problems in terms of insulation or capacitive coupling between the ferrite and the winding.

Hence, according to one alternative, the connector 20 incorporates a winding instead of the ferrite-type magnetic element. The winding thus incorporated in the connector is intended to be positioned directly in contact with the winding of the coil-spark plug assembly. The coupling between the two windings then significantly improves the frequency offsetting.

Figure 4C:
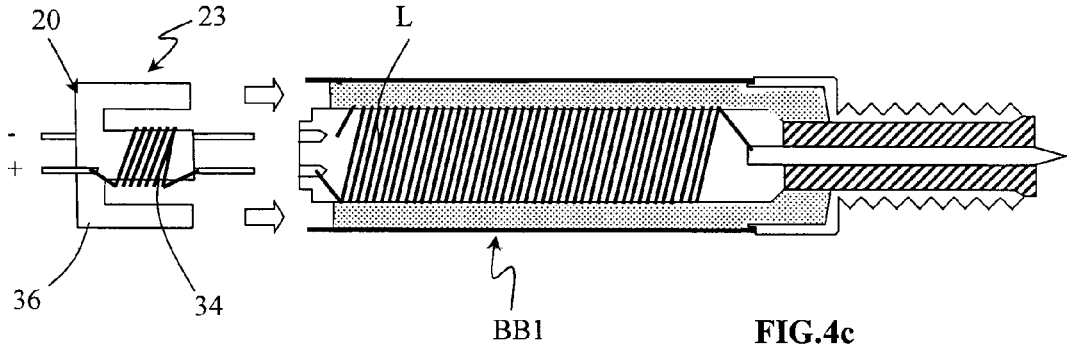

According to another alternative, which is represented in FIG. 4*c*, the connector 20 incorporates both a winding 34 and an element 36 made of magnetic material, for example of the ferrite type, which are intended to be positioned directly in contact with the coil-spark plug assembly. The winding 34 is then arranged around the magnetic element 36, which may additionally be configured so as to at least partially surround said winding.

The solutions presented above therefore consist in adding to the connector 20 of each coil-spark plug assembly an element (ferrite and/or winding) directly against the coil-spark plug assembly in order to modify its resonant frequency so as to arrive at the result that each coil-spark plug assembly connected in parallel at the outlet of the single supply circuit then has a resonant frequency which is specific to it, with these frequencies offset with respect to one another as explained above.

Figure 5:
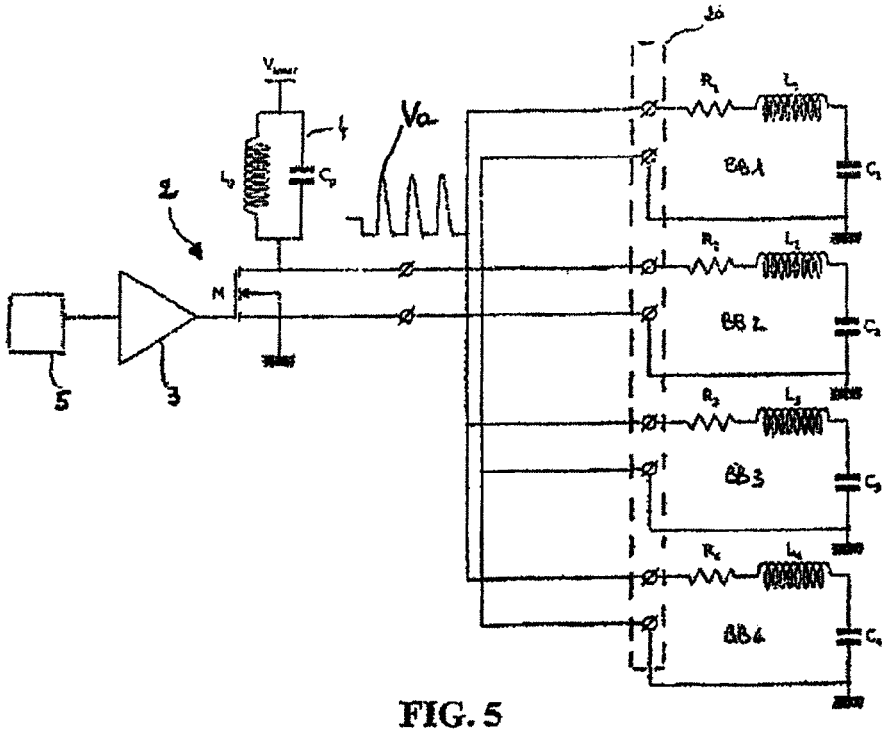
FIG. 5 illustrates an embodiment of the connection means.

According to one specific embodiment described in FIG. 5, the connectors 20 are assembled among themselves using a common, preferably rigid, connection element 26 which thus serves as a single connector with which the aforementioned frequency-offsetting elements are integrated in such a way as to offset the frequency of the coil-spark plug assembly of each cylinder in a predetermined manner.

Apart from making it possible to minimize the number of parts and hence optimize the manufacturing process, such a single connector may additionally be fastened to the engine in a reliable manner so as to ensure good mechanical resistance to vibrations, by contrast with the separate connectors which are conventionally used.

Advantageously, the connection element forming the single connector 26 comprises foolproof means 27 enabling it to be fastened to the plurality of coil-spark plug assemblies in a single manner.

It is thus possible to position in the single connector 26 the element 23 which generates the smallest (or even zero) frequency offset, for example on cylinder number no. 1, and to increase the frequency offset progressively up to cylinder no. 4, for example.

In such a configuration, the control device thus knows in advance the correspondence between the order of the control frequencies of the various coil-spark plug assemblies and the order of the cylinders. This correspondence is stored in the control device.

The method for controlling the single supply circuit must then take into account the frequency tailored to the path to be controlled for each ignition.

Figure 6:
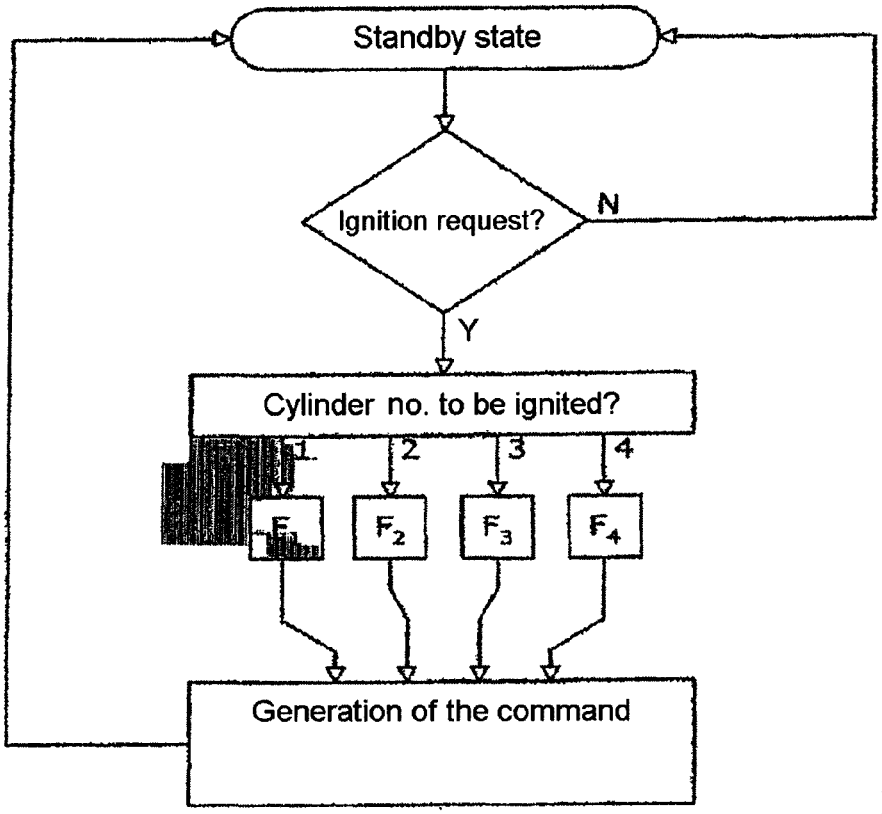
FIG. 6 illustrates a flow diagram of an example of implementing the control of the ignition system according to the invention.

According to the example in FIG. 6, on receiving an ignition request the control device is first of all able to determine the cylinder that is to be controlled, numbered from 1 to 4 in the order in which they are arranged in the engine. Each cylinder number is therefore assigned the resonant frequency, F1, F2, F3 and F4 respectively, specific to the coil-spark plug assembly to be controlled.

The control device thus comprises a module determining the frequency of the control signal to be generated, from these frequencies F1, F2, F3 and F4, as a function of the cylinder number to be ignited and of the prestored correspondence.

Once the control frequency has been determined, the control device applies the control signal at said frequency to an output interface, intended for controlling the switch M.

The selective transfer of power toward the coil-spark plug assembly to be controlled for the ignition is then of course governed by the control frequency used for this ignition.

According to one specific embodiment, the resonant frequencies to be obtained at the output of the single supply circuit can be determined using tabulation or automatic control methods as described in French patent applications FR 05-127669 and FR 05-12770 in the name of the applicant.

For example, the control device can be equipped with an interface for receiving measurement signals of engine operating parameters (engine oil temperature, engine torque, engine speed, ignition angle, intake air temperature, pressure in the combustion chamber, etc.) and/or measurement signals of power supply operating parameters, and also with a specific memory module storing relationships between measurement signals and the frequency of a control signal to be generated. The control device thus determines the frequency of a control signal to be generated as a function of measurement signals received at the reception interface and of the relationships stored in the memory module.

Applications other than the implementation of a controlled ignition for a combustion engine can be envisioned without thereby departing from the scope of the present invention, such as the implementation of an ignition in a particle filter, or of a decontamination ignition in an air-conditioning system.

The invention claimed is:

1. A plasma generating device, comprising:

a supply circuit including a switch controlled by a control signal of a control device to apply an intermediate voltage to an output of the supply circuit at a frequency defined by the control signal;

a plurality of plasma generating coil spark plug assemblies arranged in parallel on the output of the supply circuit via connectors, each connector to be connected in a removable manner to a corresponding coil spark plug assembly, a first coil spark plug assembly of the plurality including a first means to offset the resonant frequency of the first coil spark plug assembly to a first resonant frequency, and a second coil spark plug assembly of the plurality including a second means to offset the resonant frequency of the second coil spark plug assembly to a second resonant frequency separate from the first resonant frequency; and the control device for the supply circuit determines the frequency of the control signal from one of the resonant frequencies of the coil spark plug assemblies so as to selectively control the coil spark plug assemblies according to the control frequency used.

2. The device as claimed in claim 1, wherein each plasma generating coil spark plug assembly includes a resonator having a frequency above 1 MHz and including two electrodes, the resonator to generate a plasma between the two electrodes when a high voltage level is applied to the output of the supply circuit.

3. The device as claimed in claim 1, wherein the connectors are assembled among themselves using a common connection element.

4. The device as claimed in claim 3, wherein the connection element is configured to be fastened to the plurality of coil spark plug assemblies in a single manner.

5. The device as claimed in clam 1, wherein the first means to offset the resonant frequency of the first coil spark plug assembly includes means for modifying an inductance value of the coil spark plug assembly situated in the immediate vicinity of the assembly.

6. The device as claimed in claim 5, wherein the means for modifying the inductance value of the coil-spark plug assembly includes a winding positioned directly in contact with a winding of the coil-spark plug assembly.

7. The device as claimed in claim 6, wherein the winding of the modifying means is arranged around an element made of magnetic material.

8. The device as claimed in claim 6, wherein the winding of the modifying means is at least partly surrounded by an element made of magnetic material.

9. The device as claimed in claim 5, wherein the means for modifying the inductance value of the coil spark plug assembly includes an element made of magnetic material positioned directly against a winding of the coil spark plug assembly.

10. The device as claimed in claim 9, wherein the element made of magnetic material surrounds at least part of the end of the winding of the coil spark plug assembly.

11. The device as claimed in claim 9, wherein the element made of magnetic material includes a central core inserted into the winding of the coil spark plug assembly.

12. The device as claimed in claim 7, wherein the magnetic material includes ferrite.

* * * * *